US005454570A

United States Patent [19]

Karal

[11] Patent Number: 5,454,570

[45] Date of Patent: Oct. 3, 1995

[54] METHOD OF PLAYING BLACKJACK GAME

[76] Inventor: Michael Karal, 6326 N. Camden Ave., Kansas City, Mo. 64151

[21] Appl. No.: 299,539

[22] Filed: Sep. 1, 1994

[51] Int. Cl.[6] ..... A63F 1/00

[52] U.S. Cl. ..... 273/292

[58] Field of Search ..... 273/292, 274, 273/309

[56] References Cited

U.S. PATENT DOCUMENTS

| | | | |
|---|---|---|---|
| 4,651,997 | 3/1987 | Wood | 273/274 |
| 5,098,107 | 3/1992 | Boylan et al. | 273/292 |
| 5,141,234 | 1/1992 | Boylan et al. | 273/306 |
| 5,174,579 | 12/1992 | Griffiths | 273/292 |
| 5,248,142 | 9/1993 | Breeding | 273/138 R |
| 5,257,810 | 11/1993 | Schorr et al. | 273/292 |
| 5,275,416 | 1/1994 | Schorr et al. | 273/292 |
| 5,280,915 | 1/1994 | Groussman | 273/292 |
| 5,288,081 | 2/1994 | Breeding | 273/292 |

*Primary Examiner*—Benjamin H. Layno
*Attorney, Agent, or Firm*—Chase & Yakimo

[57] ABSTRACT

An improved game of blackjack allows the player to insure against the appearance of values of cards in a dealer's hand which would defeat the numerical value of a player's hand and cause the player to lose the original wager. If the wagered on value appears, the player is paid according to predetermined odds. The player will win or lose the original wager according to conventional blackjack rules. The improved game allows the player to sequentially insure against a winning dealer's hand in light of sequentially changing game conditions.

4 Claims, 1 Drawing Sheet

METHOD OF PLAYING BLACKJACK GAME

BACKGROUND OF THE INVENTION

This invention relates to the card game of "21" or blackjack and, more particularly, to an improved game of blackjack which allows a player to wager on the numerical value of cards as sequentially revealed in a dealer's hand throughout the course of a conventional blackjack game.

In the regular game of blackjack or "21" the player attempts to reach a numerical value or card count of "21" or a card count closer to "21" than the card count of the dealer's hand. The card count of each hand is conventionally determined by the numeric face value of the cards 2–10, a "10" value for face cards and a "one" or "11" value for an ace. Both the dealer and player initially receive two cards with one of the dealer's cards being in a revealed, i.e. face up position. If the player does not initially have a "21" card count, extra cards may be drawn in order to either reach the "21" count or approach the "21" count as close as possible. If the card count goes over "21," the player busts and loses his initial wager.

Once the player reaches a desired card count, the player "stands". The dealer then reveals his down card and tries to beat the player's card count. House rules normally require the dealer, having a card count less than "17," to take another card or "hit". If the dealer's card count is "17" or more, the dealer cannot take anymore cards, i.e. the dealer must "stand". At that time the player or dealer having the card count closer to "21" is the winner. Ties in the card count are denoted as a "push" with no money changing hands.

Various modifications have been proposed on the "21" game. Insurance bets are available when a dealer's face up card is an ace. Prior to any additional cards being revealed the player can wager one-half of his original bet on the dealer's down or non-revealed card being a "10" which would give the dealer a card count of "21" and defeat the player. If so, the player loses his initial wager but would win the insurance wager.

Another game has been proposed which allows a player to bet on whether the dealer reaches "21" even after the player has "busted," i.e. the card count of the player's hand has exceeded "21". The side bet is paid according to predetermined house odds.

It is thus desirable to present a card game in which the conventional game of "21" is played but will extend the player's wagering opportunities even after the player's hand has reached a desired card count value. It is also desirable to enable the player to continuously insure against the dealer besting the player's hand according to the changing numerical values of the dealer's hand.

In response thereto I have invented an improved game of "21"/blackjack in which the player upon reaching a desired card count can place an additional bet or bets on whether the dealer will achieve a card count which would defeat the player's card count. Upon the player reaching a desired card count the dealer reveals his down card. Prior to this down card revelation and prior to revelation of additional cards received by the dealer, the player can place a supplemental bet on particular card values being drawn by the dealer which would result in a dealer's hand being closer to "21" than the card count of the player's hand. If the wagered card value appears, the player will win the supplemental wager and will be paid according to predetermined odds. This winning wager will ideally offset, in whole or in part, the loss of the initial wager placed by the player on the conventional game of "21". If the wagered on card value is not drawn by the dealer, the player may win the initial wager but would lose the supplemental wager. Thus, the player may win the original wager on the game of "21;" lose the original wager and win the supplemental wager; or lose the original wager and lose the supplemental wager.

It is therefore an object of this invention to provide an improved game of blackjack which allows the player to wager on the value or values of a card of the dealer.

Still another object of this invention is to provide a game, as aforesaid, which increases the opportunities for the player to insure against losses occurring from a dealer's winning hand.

Another object of this invention is to provide a game, as aforesaid, which allows a player or other game participants to wager on the values of cards sequentially received by a dealer.

Another object of this invention is to provide a game, as aforesaid, which will generate increased wagering and player participation.

A still further object of this invention is to provide a game, as aforesaid, which is simple and easily understood.

A further object of this invention is to provide a game, as aforesaid, which increases the play making decisions presented to a player or other participants.

Still another object of this invention is to provide a game, as aforesaid, which does not interfere with the conventional play of the blackjack game.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
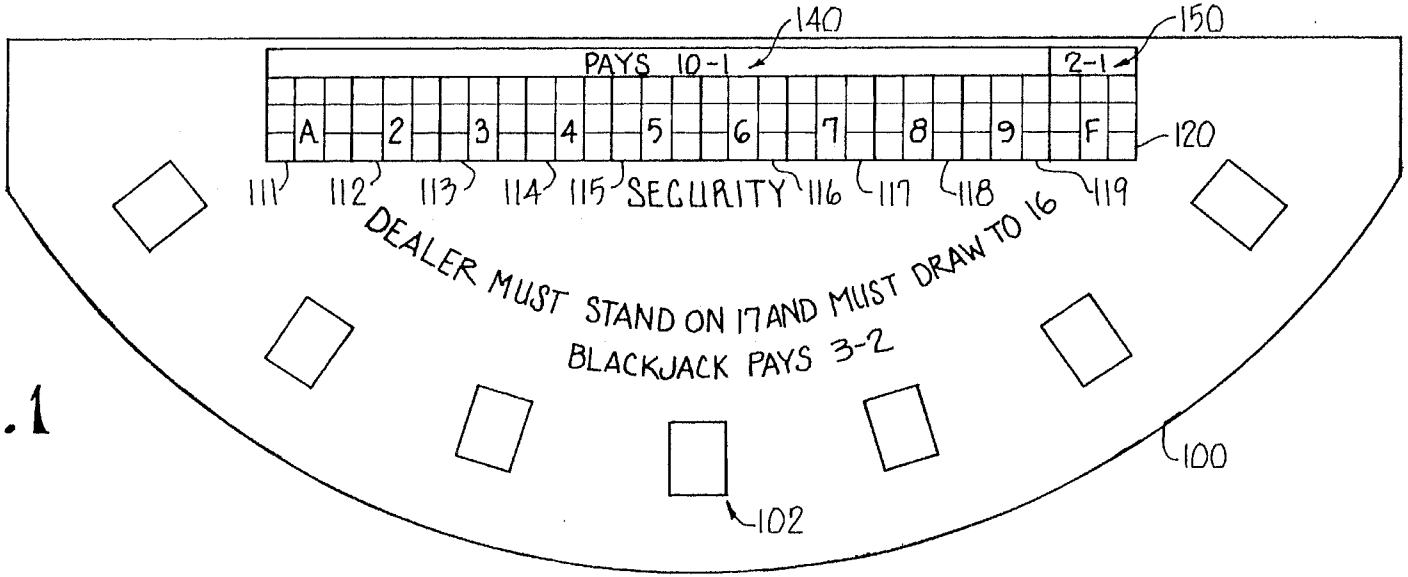
FIG. 1 shows a preferred game table layout utilized in performing the improved card game.

Upon the player taking a position 102 in front of the FIG. 1. game table 100, the conventional blackjack game begins. The player places an initial wager at his position 102 betting that the player's hand will ultimately achieve either a "21" card count value or a card count closer to "21" than the card count of the dealer's hand.

The dealer then deals two cards to the player and two cards to the dealer with one of the dealer's cards being revealed. At this time if the player's two cards have not achieved a "21" card count the player has the option of asking for another card to approach the "21" count. If the player goes over "21" with the additional card, the player "busts" and loses the initial wager. Once a player has achieved a desired count, the player "stands," i.e. no additional cards are requested from the dealer.

It is then the dealer's turn to play. Upon revealing the dealer's down card a determination is made as to whether the dealer has initially achieved the "21" count. If not, the dealer's future decisions are dictated by the house rules. Normally such rules require the dealer to draw another card if the dealer's card count is less than "17". The dealer must "stand" if the card count is "17" or over. Of course, if the dealer goes over a card count of "21" the dealer "busts". Once the dealer "stands," the card counts are compared with either the dealer or player prevailing.

Prior to the dealer revealing the down card one form of my invention allows the player to consider the dealer's up card in light of the player's card count. At this time the player may make a supplemental wager. A wager or wagers may be placed on any card values of the down or non-revealed card which may defeat the player's card count. As such the game table 100 presents betting blocks 111–119 corresponding to card values of Ace through nine and an indicia 120 corresponding to a face card or a "10". Preselected odds 140, 150 are associated with these card values, i.e. 10:1 and 2:1 as shown. If the dealer's revealed card is one of the card values wagered on by the player, the player will win the supplemental wager and will lose the original wager as the dealer's card count has bested the card count of the player's. (It is understood that ties or a "push" may also be included in the supplemental wager.) If the revealed card is not a value wagered on by the player the player loses the supplemental wager. If the dealer's card count is less than "17" the dealer must draw another card. The value or values of this additional card may also be the subject of a player's wager or wagers.

Optionally, the supplemental wager need not be authorized until after the dealer has revealed the down card and an additional card may be drawn by the dealer. Prior to the dealer drawing this additional card the player can then evaluate the card count situation and place a supplemental wager or wagers on card values of the additional card which would defeat the player's card count. If the additional card received by the dealer is a card wagered on by the player, the player wins the supplemental wager and is paid according to pre-established odds. However, the player will lose the original wager if his card count has now been bested by the dealer.

If the additional card received by the dealer is not a card value wagered on by the player, the player loses the supplemental wager. Whether the player loses the original wager depends on whether the dealer's card count has bested the player's card count. If not the player wins the original wager and is paid according to house odds. If the dealer bests the player's card count the player loses the original wager.

This process is repeated as long as the dealer is allowed to take additional cards according to the prevailing house rules. Once the dealer stands the card counts are compared and the prevailing party is decided according to conventional rules.

As a more particular example, a player has arrived at a card count of "18" and decides to stand. The dealer's revealed card is a nine corresponding to a card count of "9". At this time, the player may place a supplemental wager on the dealer drawing a face card (10 count) at 2:1 odds and/or an Ace at 10:1 odds. (Of course, this assumes that it is allowable to wager on the dealer's down card.) Either a "10" count or an Ace's "11" count will give the dealer a card count of "19" or "20" which will defeat the player's card count. If the dealer's down card is either a 10 or an Ace, the player will win the supplemental wager but will lose the original wager. Thus, the player is able to insure against the loss of the original wager. If the down card is not a "10" or an Ace the player loses the supplemental wager. If the down card is an "8" the player will win as the dealer must stand at "17".

If the dealer's down card is a seven ("7") the dealer now has a total card count of "16" and must draw another card according to house rules. The player may then place a supplemental wager or wagers on the dealer receiving an additional card having a value of "3," "4" or "5" as any of these values will provide the dealer a winning card count of "19," "20" or "21". The player may wager on any or all of these values. If such a wagered on card appears, the player wins the supplemental wager but loses the original wager as the dealer's hand has bested the player's hand. If not, the player wins the original wager but loses the supplemental wager.

Alternatively, if a player busts, i.e. the player's card count goes over "21," the player can still have the opportunity to wager on the dealer's hand if the dealer is playing against another player. Also a non-player at the table may wager on the dealer's hand without receiving any cards. Thus, supplemental wagers may be placed by a non-player participant when a dealer is competing against another player.

Accordingly, the above preferred embodiment expands the degree of player involvement in the game and provides the player sequential opportunities to insure against the loss of the player's original wager in the face of changing conditions of the value of the dealer's hand.

Figure 2:
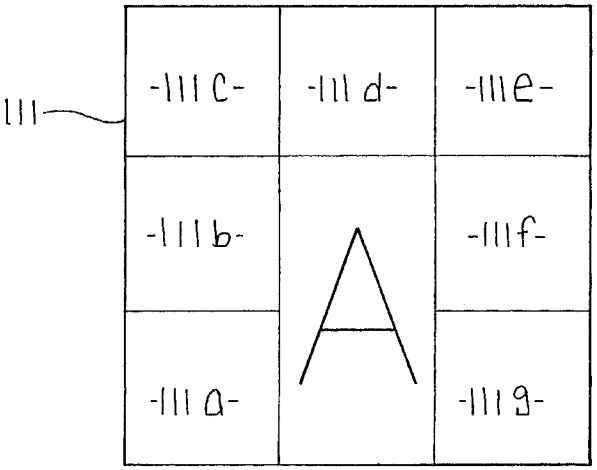
FIG. 2 shows, on an enlarged scale, one betting square of the layout of FIG. 1.

FIG. 2 shows an enlarged view of a betting block 111 of a game board. Each square is divided into seven smaller squares 111*a*–111*g*. Such squares assist the dealer in keeping track of which players have bet on the particular value of that square. Thus, square 111*a*, as viewed by the dealer, would correspond to the player on the dealer's far right with square 111*g* corresponding to the player on the dealer's far left. The intermediate squares 111*b*–111*f* would correspond to intermediate players.

Although certain forms of this invention and situations have been illustrated and described, it is understood that my invention is not limited thereto except as set forth in the following claims and allowable functional equivalents thereof.

Having thus described the invention, what is claimed as new and desired to be secured by Letters Patent is as follows:

1. An improved method of wagering in the play of a card game of "21" comprising the steps of:

a. a player making an initial wager;

b. a dealer distributing two cards to the player and two cards to the dealer with one of the dealer's cards revealed;

c. the player requesting additional cards until the player achieves a desired numerical value of cards less than or equal to a value of "21", the method terminates if said numerical value is greater than a value of "21" with said initial wager being lost by the player;

d. the player having an option of placing a first supplemental wager on the presence of one or more numerical values of the dealer's non-revealed card, the wagered on numerical value of the dealer's non-revealed card being combined with the numerical value of the dealer's revealed card to arrive at a total numerical value of the dealer's cards which would be greater than or equal to said numerical value of the player's cards but less than or equal to a total card count value of "21";

e. the player winning the first supplemental wager if the numerical value of the dealer's initially non-revealed card corresponds to the numerical value of said player's first supplemental wager;

f. the dealer sequentially taking additional cards if allowed by a pre-established procedure to achieve a desired numerical value of cards less than or equal to a "21" count and greater than said total numerical value of the player's cards;

g. prior to the dealer taking each additional card in step (f) the player having an option of placing a supplemental wager on one or more numerical values corresponding to a numerical value of each additional card to be drawn by the dealer, the wagered on numerical value of each additional dealer's card being combined with the total numerical value of the dealer's preceding cards to arrive at a total numerical value of the dealer's cards which would be greater than or equal to said desired numerical value of the player's cards but less than or equal to a total card count value of "21";

h. after revealing each additional card the player winning the supplemental wager if the numerical value of the dealer's additional card corresponds to a numerical value wagered on by the player;

i. comparing the total numerical value of the cards of the dealer's hand to the total numerical value of the cards of the player's hand when the dealer is unable to take additional cards according to said pre-established procedure;

j. awarding the initial wager by the player to the player or dealer according to said compared numerical value.

2. An improved method of wagering in the play of a card game of "21" comprising the steps of:

a. a player making an initial wager;

b. a dealer distributing two cards to the player and two cards to the dealer with one of the dealer's cards revealed;

c. the player requesting additional cards until the player achieves a desired numerical value of cards less than or equal to a value of "21" said method ending if the numerical value of the player's cards is greater than a value of "21";

d. the dealer revealing the non-revealed card;

e. the dealer taking additional cards according to a pre-established procedure to achieve a desired numerical value of cards less than or equal to a "21" count;

f. prior to each additional card of the dealer being revealed, the player having the option of placing a supplemental wager on one or more numerical values corresponding to a numerical value of each additional card to be drawn by the dealer, the wagered on value being a value when combined with the dealer's preceding cards would be a total value defeating the total numerical value of the player's cards;

g. the player winning the supplemental wager if the numerical value of the dealer's additional card corresponds to a numerical value wagered on by the player;

h. comparing the numerical value of the cards of the dealer's hand to the numerical value of the cards of the player's hand when the dealer is unable to draw additional cards according to said pre-established procedure;

i. awarding the initial wager by the player to the player or dealer according to said compared numerical value.

3. An improved method of wagering in the play of a card game of "21" comprising the steps of:

a. a player making an initial wager;

b. a dealer distributing two cards to the player and two cards to the dealer with one of the dealer's cards revealed;

c. the player requesting additional cards until the player achieves a desired numerical value of cards less than or equal to a value of "21", the method terminates if said numerical value is greater than a value of "21" with said initial wager being lost by the player;

d. a non-player having an option of placing a first wager on the presence of one or more numerical values of the dealer's non-revealed card, the wagered on numerical value of the dealer's non-revealed card being combined with the numerical value of the dealer's revealed card to arrive at a total numerical value of the dealer's cards which would be greater than or equal to said numerical value of the player's cards but less than or equal to a total card count value of "21";

e. the non-player winning the first supplemental wager if the numerical value of the dealer's initially non-revealed card corresponds to the numerical value of said non-player's first supplemental wager;

f. the dealer sequentially taking additional cards if allowed by a pre-established procedure to achieve a desired numerical value of cards less than or equal to a "21" count and greater than said total numerical value of the player's cards;

g. prior to the dealer taking each additional card in step (f) the non-player having an option of placing a supplemental wager on one or more numerical values corresponding to a numerical value of each additional card to be drawn by the dealer, the wagered on numerical value of each additional dealer's card being combined with the total numerical value of the dealer's preceding cards to arrive at a total numerical value of the dealer's cards which would be greater than or equal to said numerical value of the player's cards but less than or equal to a total card count value of "21";

h. after revealing each additional card the non-player winning the supplemental wager if the numerical value of the dealer's additional card corresponds to a numerical value wagered on by the non-player;

i. comparing the total numerical value of the cards of the dealer's hand to the total numerical value of the cards of the player's hand when the dealer is unable to take additional cards according to said pre-established procedure;

j. awarding the initial wager by the player to the player or dealer according to said compared numerical value.

4. An improved method of wagering in the play of a card game of "21" comprising the steps of:

a. a player making a first wager that the player will prevail in the conventional game of "21";

b. the player participating in the conventional game of "21" in order to arrive at a card count of less than or equal to "21";

c. after the first two cards of the dealer are revealed the player having the option of placing a second wager on the value or values of a card subsequently revealed by the dealer during the dealer's play of the game of "21";

d. the player winning said second wager if the wagered on value corresponds to said subsequent revealed card;

e. after the dealer has received all cards allowed in the conventional game of "21" the player or dealer winning the first wager according to the conventional game of "21".

* * * * *